US005743102A

United States Patent [19]

Thomas et al.

[11] Patent Number: 5,743,102

[45] Date of Patent: Apr. 28, 1998

[54] STRATEGIC MODULAR SECONDARY REFRIGERATION

[75] Inventors: Charles D. Thomas; Terry J. Broccard, both of St. Louis; Wayne G. Schaeffer, Ballwin; Doron Shapiro, St. Louis, all of Mo.

[73] Assignee: Hussmann Corporation, Bridgeton, Mo.

[21] Appl. No.: 632,219

[22] Filed: Apr. 15, 1996

[51] Int. Cl.[6] ..... F25D 17/02; F25B 1/10

[52] U.S. Cl. ..... 62/185; 62/436; 165/219

[58] Field of Search ..... 62/185, 99, 201, 62/436, 435

[56] References Cited

U.S. PATENT DOCUMENTS

| | | | |
|---|---|---|---|
| 1,980,688 | 11/1934 | Lewis | 62/115 |
| 2,315,379 | 3/1943 | Robson | 62/99 X |
| 2,669,848 | 2/1954 | Fujii | 62/3 |
| 2,986,903 | 6/1961 | Kocher et al. | 62/333 |
| 3,210,957 | 10/1965 | Rutishauser et al. | 62/255 |
| 3,280,579 | 10/1966 | Kayl | 62/156 |
| 3,363,430 | 1/1968 | White | 62/183 |
| 3,590,595 | 7/1971 | Briggs | 62/197 |
| 3,675,441 | 7/1972 | Perez | 62/510 |
| 4,000,626 | 1/1977 | Webber | 62/175 |
| 4,025,326 | 5/1977 | Leonard, Jr. | 62/175 |
| 4,280,335 | 7/1981 | Perez et al. | 62/332 |
| 4,344,296 | 8/1982 | Staples et al. | 62/175 |
| 4,751,823 | 6/1988 | Hans | 62/201 |
| 4,819,444 | 4/1989 | Meckler | 62/238 |
| 5,038,574 | 8/1991 | Osborne | 62/101 |
| 5,042,262 | 8/1991 | Gyger et al. | 62/64 |
| 5,335,508 | 8/1994 | Tippmann | 62/129 |
| 5,440,894 | 8/1995 | Schaeffer et al. | 62/203 |
| 5,483,806 | 1/1996 | Miller et al. | 62/402 |

FOREIGN PATENT DOCUMENTS

| | | | |
|---|---|---|---|
| 340115 | 2/1989 | European Pat. Off. . | |
| 0488553 | 6/1992 | European Pat. Off. | 62/99 |
| 483161 | 6/1994 | European Pat. Off. . | |
| 372897 | 4/1923 | Germany | 241/5 |
| 2112362 | 9/1972 | Germany . | |

*Primary Examiner*—William E. Wayner
*Attorney, Agent, or Firm*—Richard G. Heywood

[57] ABSTRACT

A commercial refrigeration network including refrigeration system units constructed and arranged for placement in strategic proximity to corresponding product cooling zones within the shopping arena of a food store, each refrigeration unit having a condensing unit rack configured to accommodate the maximum refrigeration loads of its associated zone with an optimum floor space footprint in the shopping arena, and the condensing unit rack including a plurality of multiplexed compressors, condenser and associated high side and low side refrigerant delivery and suction conduits operatively connected to evaporators for cooling the corresponding zone, and the network also including another cooling source remote from said modular refrigeration units and constructed and arranged for circulating a fluid coolant in heat exchange relationship with the condenser to obtain optimum condensing and efficiency of said evaporators in cooling the corresponding zone.

29 Claims, 4 Drawing Sheets

STRATEGIC MODULAR SECONDARY REFRIGERATION

BACKGROUND OF THE INVENTION (a) Field of the Invention

This invention relates generally to the commercial refrigeration art, and more particularly to modular refrigeration system units strategically located in close proximity to product zones to be cooled.

(b) Related Application

This application discloses subject matter in common with co-pending and commonly-owned application Ser. No. 08/631,104 filed Apr. 12, 1996 for Multi-Stage Cooling System for Commercial Refrigeration (Mahmoudzadeh).

DESCRIPTION OF THE PRIOR ART

Great advances have been made over the last 50 years in all aspects of refrigerated food store merchandisers and coolers and the various commercial systems therefor, but the conventional "remote machine room" approach in locating central system compressors is still widely used. Of course, self-contained commercial cases with their own condensing units will always have a place in food merchandising, particularly in small convenience stores where a few merchandising units can operate at relatively low noise levels. However, with the growth of retail food merchandising into large supermarkets, the expansion of commercial refrigeration requirements has been staggering. For example, a 50,000 square foot supermarket may have refrigerated display fixtures and other coolers and preparation rooms requiring an aggregate refrigeration capacity in excess of 80 tons (1,000,000 BTU/hr.) which may include over 20 tons of low temperature refrigeration at evaporator temperatures in the range of −35° F. to −5° F. and over 60 tons of normal temperature refrigeration at evaporator temperatures in the range of 15° F. to 40° F. Such present commercial refrigeration systems have a multitude of evaporator cooling coils for the various refrigerated product merchandisers located throughout the shopping arena of the supermarket; and these evaporators are typically cooled by multiplexed low temperature and medium temperature compressor systems using reciprocating type compressors located in the back machine room of the supermarket. It is not considered feasible to provide self-contained refrigerated product merchandisers for stand-alone operation in a supermarket setting for numerous reasons, including cost and energy efficiency. Moreover, a single compressor in a self-contained case has no back-up in case of failure, no control over its rejected heat into the shopping arena, and a large number of reciprocating compressors would generate so much noise as to be totally unacceptable.

Thus, conventional practice is to put the massive refrigeration requirements of a supermarket into at least two multiplexed back room systems; one for the low temperature refrigeration of frozen foods and ice cream at product temperatures in the range of −20° F. to 0° F.; and another for the normal temperature refrigeration of fresh foods including meat, dairy and produce at product temperatures in the range of 28° F. to 50° F. Each such system is a closed system having a single condenser/receiver and liquid header with parallel circuits to the respective merchandiser or cooler evaporators and with the various complex valving requirements to balance suction pressures (EPR valves) and to accommodate selective evaporator isolation for hot gas or other types of defrosting. In any event, the multiplexed compressors of such systems are installed in remote back machine rooms and typically connect to roof top air-cooled condensers, which in turn connect back to the machine room to a receiver and thence to the liquid header and various high side valving and liquid line circuit outlets. Again, the suction side of the various circuits are connected to a machine room suction header for each multiplexed system, and the various suction control EPR valves and hot gas distribution valves are located in this remote machine back room. To connect the back room compressors and the store merchandiser evaporators for delivery and return of refrigerant in a large supermarket of the 50,000 square foot example, substantial lengths of refrigerant conduit piping must be employed, e.g., on the order of 18,000 feet of conduit may be required in which a large volume of relatively expensive refrigerant is required just to fill these conduits for connection of the remote refrigeration systems. Should line breaks or leakage occur as from fissures in the conduits or joints (frequently caused by expansion and contraction of the conduits as during a defrost cycle), then substantial quantities of expensive refrigerant may be lost and the entire system jeopardized. The greater the length of the conduit, the more expansion will occur, creating a higher risk of breakage.

It should also be recognized that, in response to environmental concerns over depletion of the ozone layer due to the release of various CFC and HCFC refrigerants, such as R-502, the government has imposed phase out requirements on such refrigerant usage. The result is that the refrigeration industry (and others) are developing new replacement refrigerants as well as seeking other system arrangements and controls for minimizing environmental endangerment. However, such new refrigerants today are more expensive than CFC types, thereby raising basic installation costs and creating higher loss risks in conventional back room commercial systems. For instance, Refrigerant HP62, which is an HFC chemical, costs over $13 per pound.

So-called "cascade" refrigeration systems are well established refrigeration techniques to achieve low temperatures in a controlled zone or environment, particularly in industrial refrigeration and some cryogenic applications. In such cascade arrangements, a second coolant stage is typically used to cool a first stage refrigerant condenser. Briggs U.S. Pat. No. 3,590,595 discloses a cascade system for use with a remote primary system having a "back room" compressor/condenser arrangement with long liquid line conduits to the controlled refrigerated zone; and provides bypass means to obviate heat pickup and refrigerant vaporization due to intermittent evaporator cooling operations or other conditions in which the continuous liquid line flow to the evaporator is interrupted.

There are other prior patents of interest. Perez U.S. Pat. No. 4,280,335 discloses an icebank refrigerating and cooling system utilizing off-peak ice storage as a direct primary refrigeration source for various supermarket normal temperature cooling purposes, and also suggests that this system can be employed as a cascade-type heat exchanger for a vapor compression refrigerant system. Rutishauser U.S. Pat. No. 3,210,957 shows a series of self-contained merchandisers having water-cooled condenser loops from a remote source. EP patent application 0483161B1 shows a cascade system in which a secondary cooling fluid system is cooled by a central vapor-compression system and carries out the direct primary cooling of one merchandiser and thence in series flow for cooling the condenser of a self-contained merchandiser. EP patent 0340115A1 also shows a triple-cascaded vapor-compression and glycol system.

Schaeffer et al U.S. Pat. No. 5,440,894 is commonly owned and discloses an important advance in cascaded commercial systems, and this invention is an improvement stemming from this prior patent. The '894 patent discloses modular commercial system units strategically located in the shopping arena of a food store to service nearby merchandisers and the like. A remote coolant fluid system is cascaded with the modular units to provide efficient condenser cooling.

SUMMARY OF THE INVENTION

This invention is embodied in a modular refrigeration network having plural units constructed and arranged for placement in strategic proximity to corresponding product cooling zones in or adjacent to the shopping arena of a food store, each refrigeration unit includes a condensing unit rack configured to accommodate the refrigeration loads of the corresponding product zones, and each condensing unit rack includes a closed refrigeration circuit with a plurality of multiplexed compressor and evaporator means with associated high side and low side refrigerant delivery and suction means operatively connected to the evaporator means, and the refrigeration unit also includes condenser means connected between the compressor and a rack receiver as a component of the closed refrigeration circuit; and further comprising a coolant fluid system having first heat transfer means for cooling associated product cooling zones, second heat transfer means in heat exchange relationship with the evaporator means of the condensing unit rack for cooling the coolant fluid, and pumping means for circulating the coolant fluid in a closed coolant fluid loop through the first and second heat transfer means.

A principal object of this invention is to provide a dedicated modular commercial refrigeration unit disposed in close proximity to a discrete product load serviced by the unit, such as a group of refrigerated display merchandisers operating at approximately the same temperature.

Another object of this invention is to provide a plurality of modular refrigeration system units for separate dedicated product display and storage zones within a supermarket, to thereby substantially reduce the amount of refrigerant and refrigerant piping required for the system as well as parasitic losses such as liquid line heat pickup and pressure drop, and to network each modular unit with an efficient coolant fluid heat exchange system to the dedicated cooling loads of its associated product zones.

Another feature of this invention is to provide a cascade-type coolant system for a plurality of separate modular refrigeration system units to selectively discharge the heat of rejection from the refrigeration units to a location outside the supermarket or to recover such heat for in-store supermarket heating.

It is another object of this invention to lower construction costs by eliminating the need for a remote machine room for system compressors and the long piping runs to the merchandisers, and to simplify system installation and display case hookup.

Another object is to provide an efficient, economical and easily serviced secondary refrigeration system utilizing a coolant fluid for direct merchandiser cooling.

A further objective of the invention is to provide modular refrigeration system units of variable configuration to accommodate optimum placement for efficient operation and service.

Another object is to consolidate all components and conduits of a closed refrigeration system onto a modular rack, and to also incorporate the pumping means and chiller unit of a secondary coolant fluid system onto such rack whereby to minimize refrigerant requirements and maintain efficient cooling of externally located heat exchangers.

Another object is to provide modular system units minimizing refrigerant requirements, providing lower noise and vibration characteristics and energy efficient multiple compressor operation with backup capacity.

These and other objects and advantages will become more apparent hereinafter.

DESCRIPTION OF THE DRAWINGS

For illustration and disclosure purposes the invention is embodied in the parts and the combinations and arrangements of parts hereinafter described. In the accompanying drawings forming a part of the specification and wherein like numerals refer to like parts wherever they occur.

DESCRIPTION OF THE PREFERRED EMBODIMENTS

The present invention constitutes an improvement over commonly-owned Schaeffer et al U.S. Pat. No. 5,440,894, and the disclosure of such prior patent is incorporated herein by reference (as if fully set out) by way of establishing the environmental application and strategic placement of modular units within a food store as well as modular condensing unit rack configurations.

For disclosure purposes, the term "high side" is used herein in a conventional refrigeration sense to mean the portion of a system from the compressor discharge to the evaporator expansion valves, and the term "low side" means the portion of the system from the expansion valves to the compressor suction. Also, "low temperature" as used herein shall have reference to evaporator temperatures in the range of −35° F. to −5° F. or the associated frozen food and ice cream product temperatures in the range of −20° F. to 0° F.; and "normal temperature" means evaporator temperatures in the range of about 15° F. to 40° F. or the associated non-frozen or fresh refrigerated food temperatures in the range of 25° F. to 50° F. "Medium temperature" is sometimes used interchangeably for "normal temperature" in the refrigeration industry.

Figure 1:
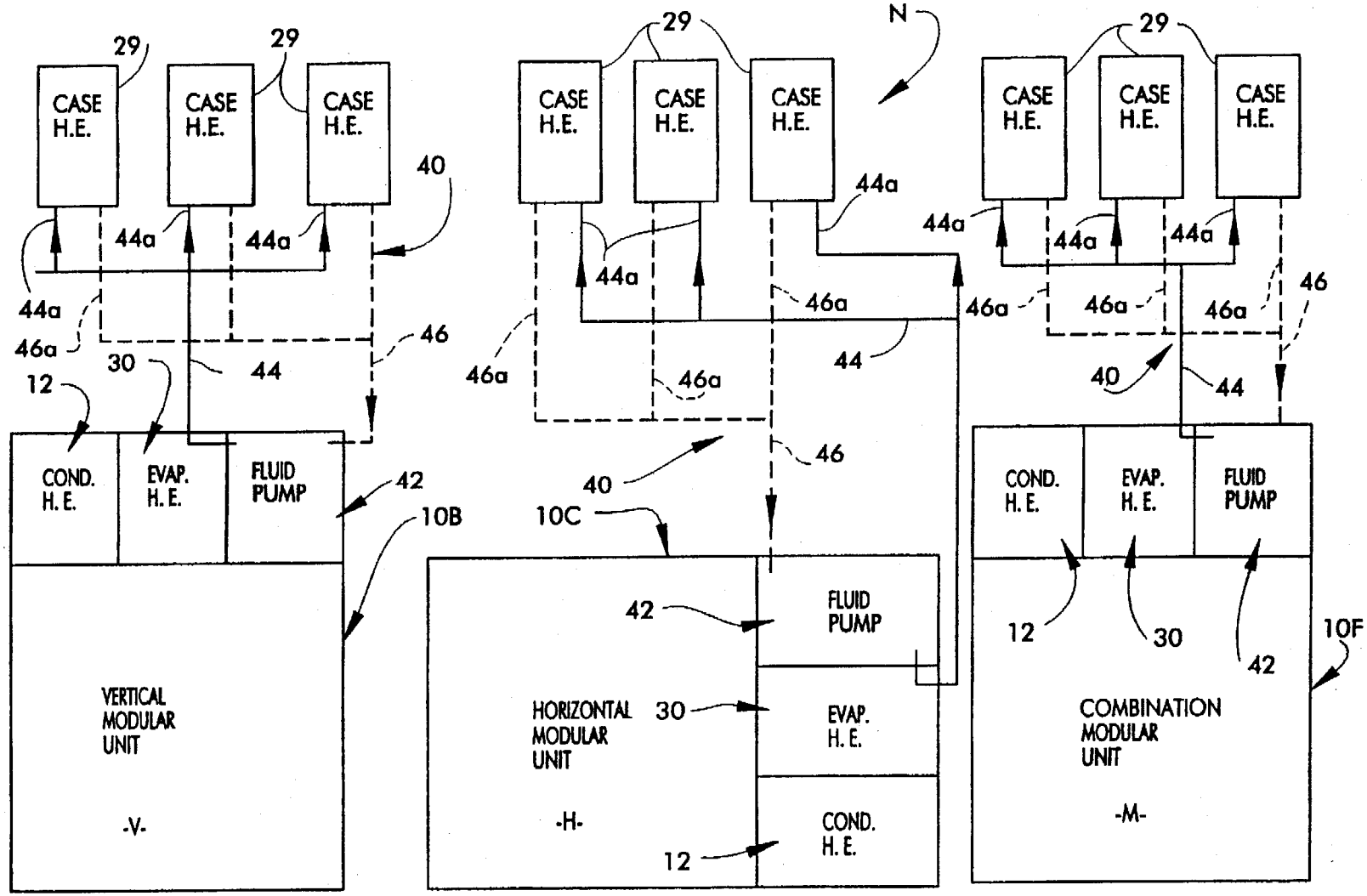
FIG. 1 is a block diagram illustrating three alternative modular secondary refrigeration networks embodying the invention and as utilized in a supermarket.
Figure 2:
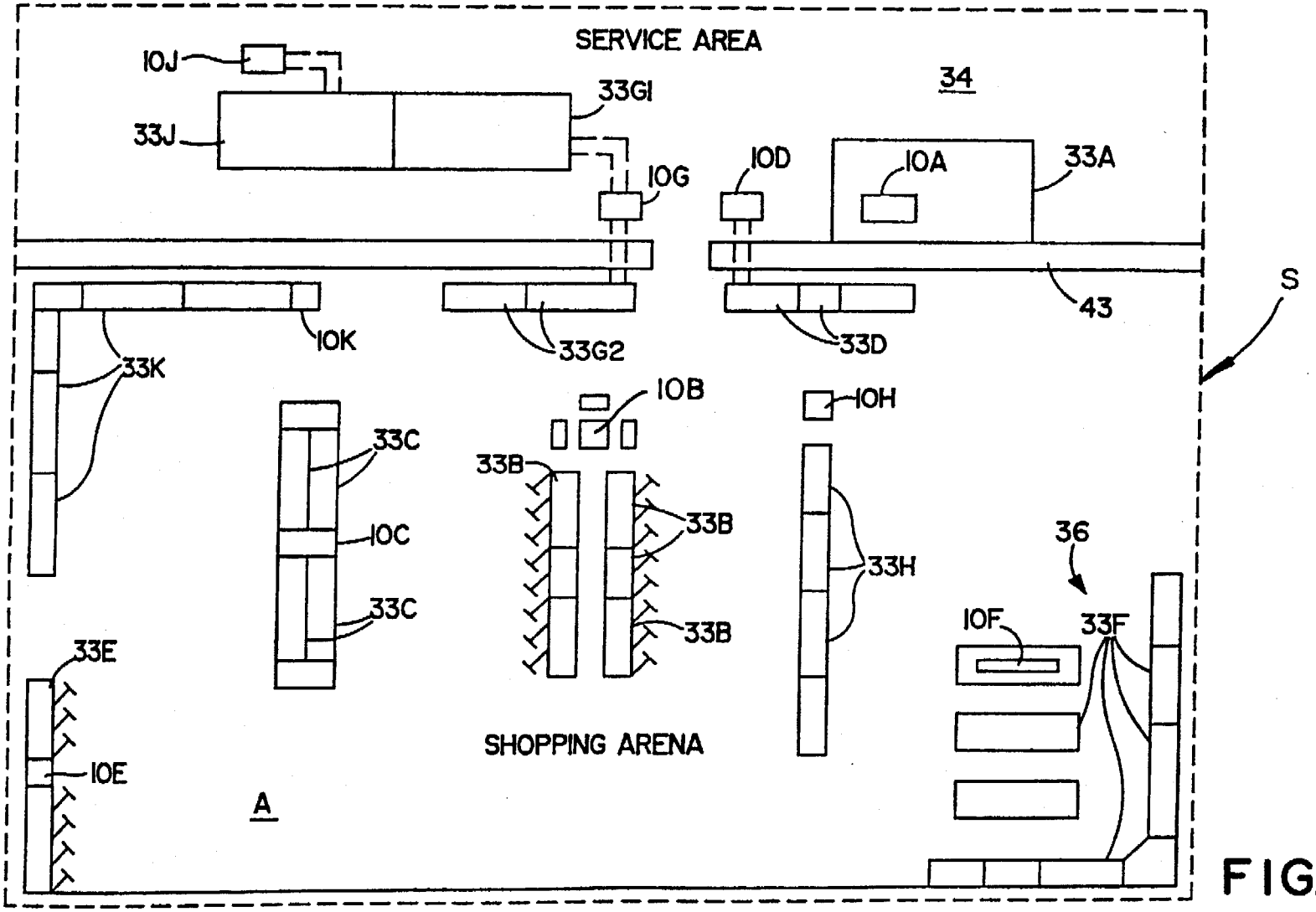
FIG. 2 is a representative supermarket floor plan illustrating the strategic placement of dedicated modular refrigeration system units relative to the respective refrigeration loads.

Referring now to FIGS. 1 and 2 of the drawings, the invention is illustrated diagrammatically in the form of a commercial refrigeration network N having a plurality of modular refrigeration system units 10 constructed and arranged for placement in strategic proximity to corresponding product cooling zones within a commercial foodstore or supermarket S. The location of the refrigeration units 10 may be inside or outside the customer shopping arena A of the supermarket. Each modular refrigeration unit 10 is sized to efficiently maintain its associated discrete cooled zones at optimum refrigeration temperatures, and each of these zones comprises one or more of the supermarket coolers, freezers, preparation rooms or display merchandisers—usually an area department or lineup of merchandising fixtures operating at substantially the same temperature.

Figure 3:
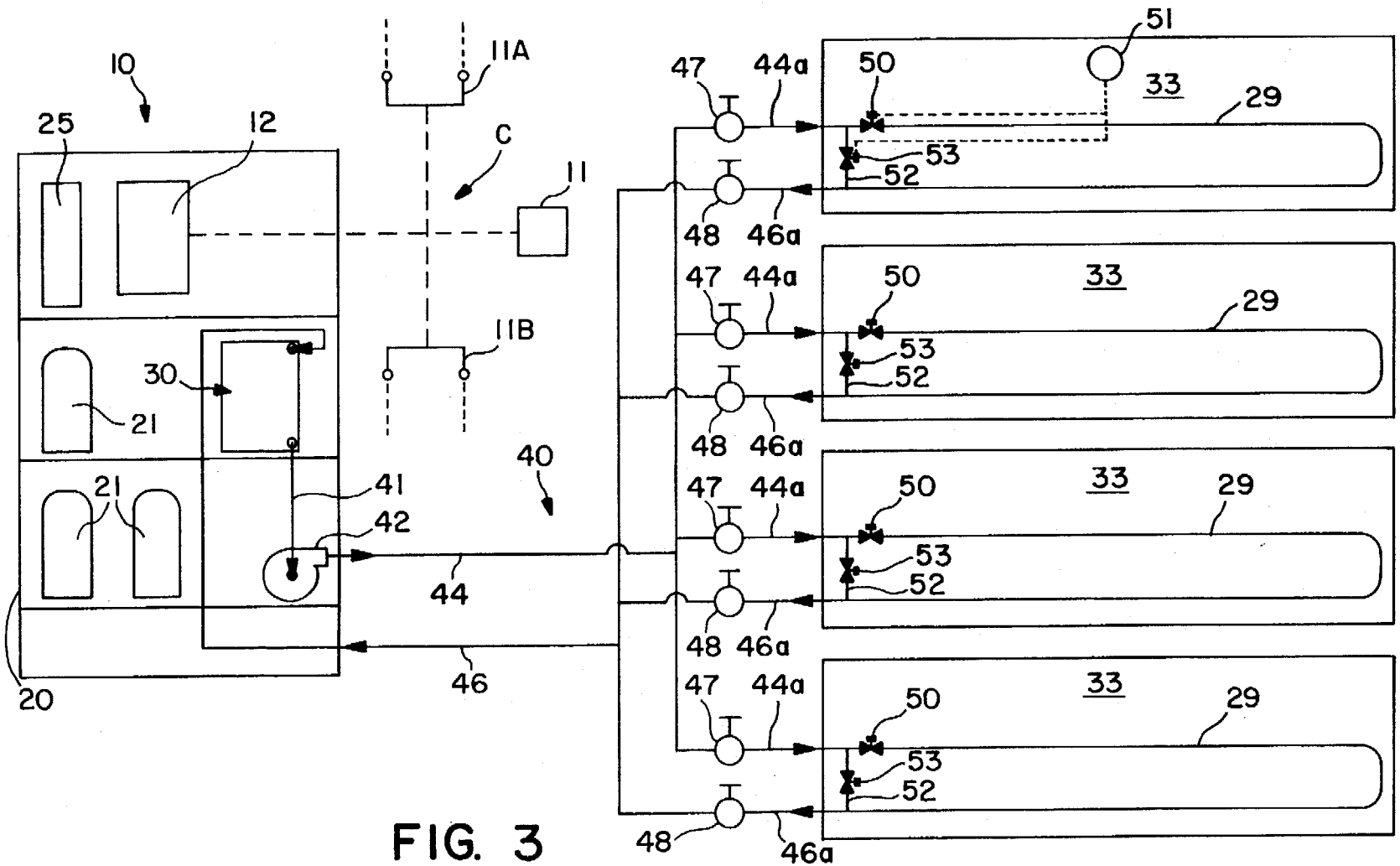
FIG. 3 is a schematic flow diagram of a typical modular secondary refrigeration unit and distributed cooling loops thereof.
Figure 4:
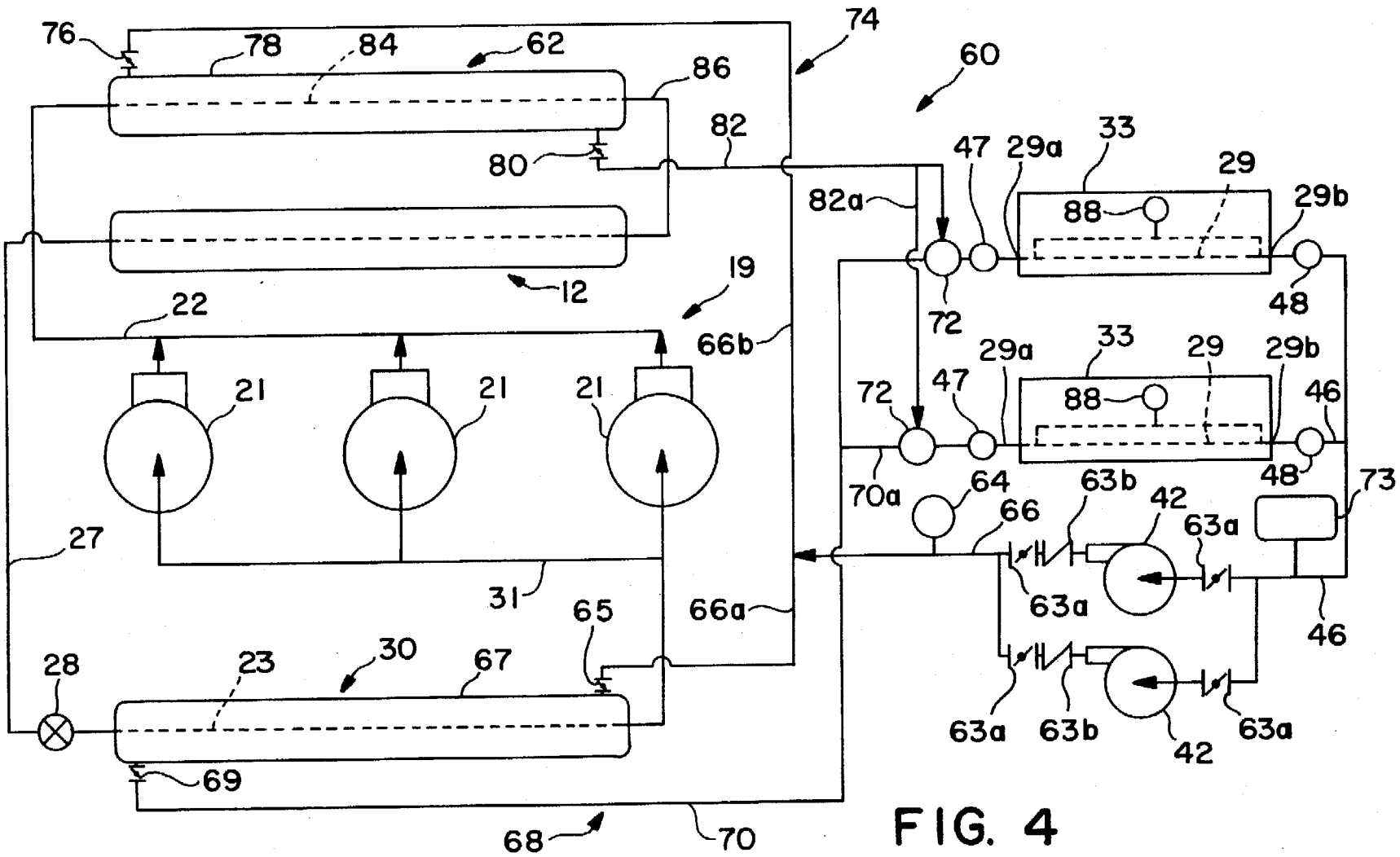
FIG. 4 is a schematic flow diagram illustrating a modified embodiment of the secondary refrigeration unit and dedicated distribution loops thereof.

The modular nature of the invention utilizes three basic variable forms of the refrigeration system unit 10: a vertical compressor configuration V, such as 10B (FIG. 2); a horizontal compressor configuration H, such as 10C (FIG. 2); and a combination or mixed horizontal and vertical compressor configuration M, such as 10F (FIG. 2). Referring to FIGS. 3 and 4, each of the modular system units 10 includes a condensing unit rack 20 constructed and arranged to mount and support the operative components of a closed refrigeration circuit 19 dedicated to the refrigeration load requirements of its associated discrete product zones 33. Thus, a typical condensing unit rack 20 of the present invention preferably may include two to ten small multiplexed scroll compressors 21 or a similar variable capacity compressing means that is connected by a discharge header 22 to the system condenser 12, also preferably located on the rack 20. An oil separator 25, such as the oil system described in U.S. Pat. No. 4,478,050, may be incorporated into the system 19 downstream of the discharge manifold 22. In the preferred embodiment, the closed (vapor compression) refrigeration system 19 is critically charged with refrigerant and therefore has no liquid receiver to receive the condensate outflow from the condenser 12. Thus, the refrigeration system 19 is charged only with the minimum amount of refrigerant necessary for it to operate. However, it is to be understood that a liquid receiver (not shown) and a more than critical amount of refrigerant may be employed without departing from the scope of the present invention. The high side of the circuit 19 is connected by liquid line 27 to an evaporative expansion valve 28 for evaporator means 23 forming a part of the closed refrigeration circuit 19 and being constructed and arranged with the coolant chiller unit 30, to be described. On the low side, the refrigerant in the evaporator 23 removes heat from the coolant fluid and the outlet of the evaporator 23 connects by suction line 31 to the suction side of the compressors 21 to complete the closed refrigeration circuit. Although the refrigeration system condenser 12 is preferably located on the unit rack 20, it may be roof mounted outside the food store for air cooled operation in a typical manner. When located on the rack 20 it is essential that the sensible heat be rejected outside the shopping arena, and the condenser 12 thus may be cooled in numerous ways. As taught in U.S. Pat. No. 5,440,894, a coolant fluid circulating system C can be provided to circulate a cooling fluid or coolant from a remote source (11) to the respective unit condenser/heat exchangers 12 marked "COND. H.E." in FIG. 1. Thus, the coolant system C derives a cooling liquid, such as water or glycol, from one or more remote sources 11, 11A and 11B and circulates it to the condenser/heat exchanger H.E. of each modular unit 10. The coolant source 11 may be a single fluid cooling apparatus, such as a closed or open loop roof top cooling tower 11A or a ground source water supply 11B, or a chiller system or recirculating water source 11 or a combination of such alternate fluid cooling sources to assure a continuous supply of coolant at a substantially constant temperature. It will be understood that these individual modular refrigeration system units 10 will generally include still other system components, such as defrost system means, system performance sensing and operating control panel and microprocessor apparatus, alarm systems and the like.

The invention further comprises the use of a secondary coolant system 40 for the direct distributed load cooling of the heat exchange coils 29 of the merchandisers 33 dedicated to the respective units 10. Thus, in the preferred embodiment (FIG. 1), the rack mounted refrigeration system evaporator (EVAP. H.E.) is part of the heat exchanger chiller unit 30 for the coolant system. Preferably the pumping means 42 for the secondary cooling system 40 is also rack mounted, and is connected to circulate the glycol coolant fluid or the like through the chiller heat exchanger 30 and thence outflow through conduit 44 to its distributed load at each associated merchandiser display case heat transfer coil 29. The cold coolant fluid removes heat from the coil 29 (typically of conventional tube and fin construction) and the fluid is thence circulated back to the pump 42 through return conduits 46. The construction and operation of the modular secondary system of the present invention will be more fully described in greater detail.

A principal feature of the invention is to place the modular refrigeration units 10 strategically throughout the supermarket in close proximity to the dedicated cooling zone (33) of an associated merchandiser department or case lineup in order to eliminate the traditional machine back room, long piping connections and large refrigerant requirements formerly required. Directly comparing refrigerant requirements for a 50,000 square foot supermarket—(1) conventional prior art supermarket refrigeration systems of the remote back-room type may require 2464 lbs. of R-12 for medium temperature fixtures and 880 lbs. of R502 for low temperature fixtures (totalling 3344 lbs.); (2) the modular unit network of Schaeffer et al U.S. Pat. No. 5,440,894 required 700 lbs. of R404a for medium temperature and 300 lbs. of R404a for low temperature (totalling 1000 lbs. of non-CFC refrigerant); and (3) the networked system of the present invention will require only 60 lbs. of R404a for medium temperature and 40 lbs. of R404a for low temperature (a total of 100 lbs. for the entire store).

The savings in refrigerant charge over that of the modular unit network of U.S. Pat. No. 5,440,894 is derived in part from elimination of refrigerant lines in the refrigeration system 19 extending to the particular plural merchandisers serviced by the modular refrigeration unit 10. All of the components of the vapor compression refrigeration system 19 of the refrigeration unit 10 are closely coupled (e.g., within about two feet of each other), and mounted on the condensing unit rack 20. The close coupling of the refrigeration system components substantially reduces the dynamics within the system 19. Moreover, the relatively large thermal mass of the coolant fluid (as compared to conventional refrigerant) moderates the variations in loads seen by the system 19. A result of the near steady state operation of the refrigeration system 19 is that, in the preferred embodiment, only a critical charge of refrigerant is believed to be required.

Referring to FIG. 2, a typical supermarket floor plan diagrammatically illustrates the strategic deployment of refrigeration units 10 embodying the invention. Refrigeration unit 10A is a low temperature system dedicated to maintain frozen meat products in a meat freezer (cooling zone 33A) located in a service area 34 outside the shopping arena A; refrigeration unit 10B is a low temperature system for a dual back-to-back lineup of frozen food reach-in merchandisers 33B within the shopping arena; refrigeration unit 10C is low temperature system dedicated to maintain ice cream product temperatures of about −20° F. in twin island "coffin" type merchandisers 33C in the shopping area; refrigeration unit 10D is a medium temperature system located outside the shopping arena A, but immediately adjacent to its discrete service load of multi-deck meat merchandisers 33D in the shopping arena; refrigeration unit 10E is a medium temperature system for a lineup of non-frozen reach-in product fixtures 33E in the shopping arena A; refrigeration unit 10F is a medium temperature system servicing the produce department merchandisers 33F operating at temperatures in the range of 45° F. to 50° F.; refrigeration unit 10G is a medium temperature system also located in the service area 34 outside the shopping arena, but constructed and arranged to service both a deli walk-in cooler 33G1 in the service area and a deli merchandiser lineup 33G2 in the shopping area A; refrigeration unit 33H is a medium temperature system for servicing a line of multideck produce merchandisers 33H; refrigeration unit 10J is a low temperature system dedicated to an ice cream walk-in freezer 33J in the service area 34; and refrigeration unit 10K is a medium temperature system associated with the dairy department lineup of multideck merchandisers 33K. Thus, the conventional compressor machine room of prior art supermarkets is eliminated in favor of the modular refrigeration units 10A–10K strategically located in and around the supermarket shopping arena. The modular secondary refrigeration units 10 are specifically located in close proximity to the associated group of storage or display merchandising zones operated at the same temperature and forming a discrete cooling load.

The locations of the modular refrigeration units 10, whether in the shopping arena A or behind a wall 43 just outside the shopping arena, as in the service area 34 where storage coolers and freezers 33A and 33J and other warehousing and employee stations are located, are in close proximity to the associated refrigeration loads to be serviced by the respective units. As stated, the refrigeration network of the present invention requires about 80%–90% less refrigerant than the modular system disclosed in Schaeffer et al U.S. Pat. No. 5,440,894 inasmuch as all refrigerant circuitry of the closed system 19 is contained on the rack 20, except in the case of a roof-mounted condenser 12 as discussed. It should again be noted that the system of the '894 patent itself resulted in a 75% reduction in piping lines over conventional back room systems. In the distributed load arrangement of the present invention, in the event of any leak or damage to the modular refrigeration unit it is only possible to lose the refrigerant from that one closed circuit unit so the potential damage to the environment and the cost of replacing refrigerant are reduced to an absolute minimum. In addition, in the preferred embodiments, the outlawed conventional CFC refrigerants (e.g., R-12 and R-502) are replaced with R404a or the like which are environmentally acceptable. Similarly, the coolant fluid delivery and return conduit loops are piped from the rack 20 to extend to all of the closely adjacent associated refrigerated zones 33. Thus, the conduits for the liquid coolant are not subject to temperature changes and parasitic losses, as in prior refrigerant conduits, since the coolant delivery and design return lines are relatively short and will be at substantially constant design temperatures (and further the leakage of glycol or like coolants is neither as environmentally hazardous nor costly to replace).

The modularity of the condensing rack units 20 reduces the time and cost of installing the refrigeration system network and simplifies service, as compared to conventional back room refrigeration systems. It is not necessary to construct a machine room to house the massive prior art central compressor systems or construct the complex piping runs from such a remote system or from a remote central glycol circulating system. Moreover, since the alternate configurations of the refrigeration unit components are predesigned and factory installed, field assembly of conduit joints are virtually eliminated.

It is understood that the condensing unit rack configurations shown in FIGS. 8 and 9 of the U.S. Pat. No. 5,440,894 patent are illustrative of the present unit racks 20 and may be modified by eliminating one or more compressors 21 to accommodate the placement of the glycol chiller 30 (i.e., evaporative heat exchanger) and other glycol system components such as the fluid pump 42. The flexibility in the modular refrigeration system units permits these dedicated units 10 to be located unobtrusively within the shopping arena A of a supermarket in such a way as to blend with the closely adjacent configurations of refrigerated product storage coolers and display merchandisers with their associated cooling zones to be cooled by the distributed glycol coolant. The placement of the refrigeration units (10) in the shopping arena A is commercially feasible because the compressor noise is substantially eliminated or reduced to acceptable decibel levels of no greater audibility to shoppers than the usual background noise of the supermarket (e.g., 60 to 65 dB). The preferred compressors 21 of the present invention are small scroll compressors, but even one compressor constructed and arranged to have a variable refrigerating capacity can provide efficient glycol cooling within the required envelope for low temperature and medium temperature operations.

As briefly described with reference to FIG. 1, the modular refrigeration units 10 in the supermarket may derive their respective condenser cooling from a common remote liquid cooling source 11 or the condenser itself may be removed from the rack and be roof mounted to dissipate heat outside the store. The circulation of a controlled coolant in a heat exchange relationship with the unit condensers provides optimum condensing and refrigeration efficiency of the evaporator chillers 30 in cooling their respective coolant fluid loads.

Referring specifically to FIG. 3 showing one embodiment of the invention, the refrigeration rack 20 accommodates plural compressors 21 in combination of vertical and horizontal displacement and also accommodates the other components of the closed refrigeration circuit 19 including oil separator 25, filter and drier (not shown) condenser means 12 and receiver (not shown). In addition, the system evaporator is part of the glycol chiller 30, which is rack mounted and thus the entire closed refrigeration circuit 19 is closely piped and requires an absolute minimum of refrigerant. The pumping means 42 for the coolant fluid circuit 40 is also rack mounted adjacent to the chiller 30 thereby minimizing the length of coolant line 41 therebetween. In this embodiment the pump 42 draws cold coolant from the chiller 30 for direct discharge to the heat transfer coils 29 of the product fixtures 33.

The main delivery conduit 44 from the pump 42 is sized to deliver cold coolant fluid to smaller branch conduits 44*a* to the respective dedicated fixture coils 29, and the branch return conduits 46*a* from the coils 29 connect with main return conduit 46 connecting back to the chiller unit 30. A balance valve 47 is provided on the branch inlet conduit 44*a* to each coil 29, and an isolation or service valve 48 is provided in each return branch conduit 46*a*. The balance valves 47 are adjusted to a predetermined flow throttling position to adjust or preset the coolant flow rate to the respective fixture and thus balance the overall proportioning of the closed coolant circuit 40. The balance valves 47 will also function as an isolation valve (48) for installation and service of the fixture 33.

Coolant fluid flow in the heat transfer coil 29 of the fixtures 33 is also controlled by a solenoid valve 50 at the inlet to the coil 29, which valve 50 may be modulated to vary the volume of fluid flow and adjust the cooling effect in response to a temperature sensor 51 in the associated product zone (33). Preferably, however, a by-pass line 52 upstream of valve 50 and controlled by a by-pass solenoid 53, will be sized to simulate the coil volume whereby—in response to the sensor 51 signalling that the cooling is sufficient—the inlet solenoid 50 will be closed and the by-pass solenoid opened to short circuit coolant flow to the return conduit 46*a* thus maintaining the balance of coolant flow circulating in the entire circuit 40.

Another embodiment of the modular commercial refrigeration unit of the present invention is diagrammatically illustrated in FIG. 4 to be constructed and arranged for defrost by circulation of heated coolant fluid through the heat exchanger coil 29. The operation of the closed refrigeration circuit 19 is substantially as described above, with one exception described hereinafter. The modular commercial refrigeration unit includes an integrated, closed, coolant fluid circuit 60 having a cooling heat exchanger (the coolant chiller 30) and a heating heat exchanger 62. The pumping means comprises a pair of pumps 42 piped in parallel with each other in the coolant fluid circuit 60. The pumps 42 ordinarily operate in alternating periods for circulating coolant fluid through the circuit 60. However, the pumps 42 are capable of operating in tandem if low pressure is detected in the circuit by pressure sensor 64. Each of the pumps 42 has associated isolation valves 63*a* and check valves 63*b*.

In the normal cooling or refrigerating stage for the associated product zones 29 of the modular refrigeration unit 10, one of the pumps 42 discharges coolant fluid outwardly through discharge conduit 66 and a branch 66*a* thereof through a valve 65 to the cooling heat exchanger or chiller 30 in which the fluid is cooled to a predetermined selected temperature. In the FIG. 4 embodiment, the chiller 30 includes a reservoir 67 for holding a quantity of chilled coolant fluid cooled by the evaporator coil 23 of the closed refrigeration circuit 19, and from which the cold fluid flows through a valve 69 into a first loop 68 through conduits 70, 70*a* leading to flow control valve means—shown in the form of three-way valves 72 on the inlet side 29*a* to the heat exchange coils 29. It is to be understood that other valving arrangements and sensors (not shown) may be used for controlling the flow of coolant through the heat exchange coils 29 for precise control of air temperature within the fixtures 33. As in the FIG. 3 embodiment, a balance valve 47 is provided on the branch inlet conduit to each coil 29, and an isolation or service valve 48 is provided in each return branch conduit 46*a*. The outlets 29*b* from the heat exchange coils 29 are connected by the return conduits 46 back to the negative (suction) side of the operating pump 42 and a surge accumulator or expansion tank 73 that will accommodate volumetric fluctuations in the coolant fluid flow is provided.

The coolant fluid circuit 60 also has a second coolant circulating loop 74 through the heating heat exchanger 62 and in by-pass relation with the first loop 68 between the discharge conduit 66 and the three-way valves 72 at the respective fixtures 33. In the second loop 74, a branch conduit 66*b* leads from the discharge conduit 66 through an isolation or service valve 76 to the heating heat exchanger 62, which preferably forms a reservoir 78 or receiver of preselected capacity to hold a prescribed volume of heated coolant fluid therein. This heat exchanger 62 is constructed and arranged to provide a substantially continuous internal heating source for the body of fluid in the receiver, and this heated body of fluid is sometimes referred to as "hot glycol" or "hot gel" and forms a heat source for defrosting the heat exchange coils 29. Thus, the outlet from the reservoir 78 connects through another normally-open service valve 80 and conduits 82, 82*a* to the flow three way valve 72.

The closed vapor compression refrigeration circuit 19 differs from that shown in FIG. 3 in that the multiplexed compressors 21 discharge hot refrigerant vapor through line 22 to a first or preliminary condenser coil 84 disposed within the reservoir 78 of the hot glycol heat exchanger 62, whereby the body of hot glycol is maintained at defrost temperature by the sensible heat (and heat of compression) recovered from the refrigerant. The refrigerant passes from the reservoir 78 through a line 86 into the condenser 12 for final condensing before returning to the evaporator 23 in the chiller 30.

During normal refrigeration of the fixtures 33, the three way valves 72 are positioned so that no heated coolant from the reservoir 78 may pass into the heat exchange coils 29. Instead, the cooled coolant in the first loop 68 is circulated through the coils 29 by the pump 42. In the illustrated embodiment, a sensor 88 is provided for detecting the temperature of the coolant as it enters and exits each heat exchanger coil 29. The detected temperatures are then compared by the sensor 88. Frost forming on the coils 29 during normal refrigeration will insulate the coils, causing progressively less heat to be transferred to the coolant passing through the coils. If the difference between the entry and exit temperature of the coolant falls below a predetermined minimum (e.g., 2.5° F.), the three way valve 72 is signalled to switch to a position which permits heated coolant fluid to flow from the line 82 through the coil 29 for defrosting the coil. After a selected period of time the three way valve 72 resets to normal refrigeration so that cooled coolant fluid again flows from the chiller 30 through the coil 29, and the heated coolant fluid from the reservoir 78 prevented from entering the coil. It is to be understood that the onset and termination of defrost may be controlled other than described herein without departing from the scope of the invention. Moreover, the fixtures may be defrosted at the same time or at different times. As before, the entire refrigeration circuit 19 and secondary coolant fluid circuit 60, including the second (defrost) loop 74, is contained on the condensing unit rank 20 and associated fixtures 33.

It is also understood that other conventional defrost arrangements may be selectively used for the evaporators 29 of different merchandisers. For instance, in produce merchandisers where the evaporators operate at barely frosting temperatures, off-cycle defrost is an accepted industry practice. Electric defrost means (not shown) is also well-known and frequently preferred in some merchandiser fixtures. In open front, air curtain merchandisers, reverse air flow may be used as a defrost alternative to the direct introduction of heat into the merchandiser as with electric and heated coolant fluid defrost systems.

It will be readily apparent that the modular refrigeration units of the present invention provide a greatly improved, environmentally sound refrigeration network integrated with a master coolant circulating system. The scope of this invention is intended to encompass such changes and modifications as will be apparent to those skilled in the art, and is only to be limited by the scope of the claims which follow.

What is claimed is:

1. In combination: a modular refrigeration unit including a condensing unit rack constructed and arranged for placement in strategic proximity to multiple refrigerated fixtures having temperature associated product cooling zones within the shopping arena of a food store, said refrigeration unit being configured to accommodate the maximum aggregate refrigeration loads of the associated cooling zones and comprising primary closed refrigeration circuit components mounted on said condensing unit rack including a plurality of multiplexed compressor means and evaporator means with associated high side and low side refrigerant delivery and suction means operatively connected thereto; and said refrigeration unit also including condenser means connected between the compressor means and evaporator means as a component of the closed refrigeration circuit; and other means constructed and arranged for cooling the condenser means; and a secondary coolant fluid system having first heat transfer means directly associated with multiple fixtures and being constructed and arranged to operate at frosting temperatures for cooling the temperature associated product cooling zones thereof, second heat transfer means comprising a liquid chiller in heat exchange relationship with the evaporator means of the closed refrigeration circuit for cooling the coolant fluid to frosting temperatures, and pumping means for circulating the coolant fluid in a closed coolant fluid loop through the first and second heat transfer means, at least one of the liquid chiller and pumping means of the coolant fluid system being disposed on the condensing unit rack.

2. The improved refrigeration unit of claim 1 wherein the closed refrigeration circuit contains a predetermined critical charge of vapor compression refrigerant.

3. The combination of claim 1 wherein the evaporator means is an integral part of the liquid chiller, and the liquid chiller and the pumping means are disposed on said condensing unit rack.

4. The improved refrigeration unit of claim 1, in which said condensing unit rack is configured to accommodate two to ten separate compressors at predetermined rack positions, and said other components have predetermined rack positions relative to said compressors.

5. The improved refrigeration unit of claim 1, in which said compressors are sized in the range of a fractional horsepower up to about ten horsepower, and are constructed and arranged to provide a variable refrigeration capacity balanced to the refrigeration loads imposed by the associated product zones.

6. The improved refrigeration unit of claim 5, in which said compressors are of a rotary type constructed and arranged to operate at low noise and vibration levels.

7. The improved refrigeration unit of claim 6, in which said compressors are scroll compressors.

8. The combination of claim 1, including valve means for controlling coolant fluid circulation through the first heat transfer means and being operable in response to the sensed temperature in the product zone.

9. The combination of claim 1, wherein said condensing unit rack comprises a main frame and support platform means thereon, the main frame and said support platform means being constructed and arranged to accommodate selective placement of a variable number of the compressor means in predetermined horizontal and vertical combinations with each other and with said liquid chiller or pumping means on said support platform means.

10. The combination of claim 9, wherein the support platform means comprises at least two support platform panels mounted on the main frame at vertically spaced levels and accommodating said plurality compressor means and liquid chiller or pumping means in vertically disposed relationships.

11. The combination of claim 1, wherein said means for cooling coolant fluid in said first loop includes reservoir means constructed and arranged to hold a predetermined volume of cold coolant fluid in transit to the second heat transfer means to be cooled.

12. The combination of claim 1 wherein the secondary coolant fluid system is substantially wholly contained within the shopping arena in close proximity with the condensing unit rack.

13. The combination of claim 1 wherein said other means comprises a second coolant circulating system in heat exchange relationship with the condenser means of said condensing unit rack.

14. The combination of claim 1 further comprising means for defrosting the first heat transfer means of the secondary coolant fluid system.

15. The combination of claim 14 wherein the closed coolant fluid loop constitutes a first coolant fluid loop and wherein the defrosting means comprises a second coolant fluid loop between the pumping means and the first heat transfer means in by-pass relationship with the first coolant fluid loop, heating means in the second loop, and control means for selectively controlling coolant fluid circulation by the pumping means through the first and second loops.

16. The combination of claim 15 wherein said control means comprises a sensor constructed and arranged for detecting coolant temperature at the inlet and outlet of the first heat transfer means, and valve means operated by the sensor to permit flow of coolant through the first heat transfer means when the difference between the coolant inlet and outlet temperatures falls below a predetermined amount.

17. The coolant fluid system of claim 15 wherein said second coolant fluid loop is constructed and arranged for continuous fluid communication with the first coolant fluid loop on the positive pressure side of said pumping means.

18. The coolant fluid system of claim 17 wherein the pumping means and said first and second coolant fluid loops are constructed and arranged for balanced coolant fluid pressure flow through the loops.

19. The combination of claim 15 wherein the heating means comprises a heat exchanger for exchanging heat between the condenser means and the second loop.

20. The coolant fluid system of claim 17 wherein the heat exchanger for heating coolant fluid in the second loop includes a coolant fluid reservoir constructed and arranged to be substantially continuously heated for maintaining a supply of hot coolant fluid for use in defrosting the heat transfer means in said product merchandisers.

21. The coolant fluid system of claim 20 in which there are multiple first heat transfer means designed for product cooling in substantially the same temperature range, and wherein said coolant fluid reservoir is sized to hold a supply volume of heated coolant fluid that is capable of defrosting the first heat transfer means of more than one first heat transfer means through the second loop at the same time.

22. The coolant fluid system of claim 21 wherein said means for controlling coolant fluid circulation comprises valve means for selectively connecting the first and second loops to the inlet side of the heat transfer means of a product merchandiser.

23. The combination of claim 1, wherein said secondary coolant fluid system includes means for controlling cold coolant fluid flow in said first heat transfer means.

24. The combination of claim 23, in which said means for controlling comprises flow control valve means constructed and arranged with the inlet side of said first heat transfer means.

25. The combination of claim 24 in which said valve means comprises a balance valve for throttling coolant fluid flow to a preselected flow rate.

26. The combination of claim 24 in which said valve means comprises a modulating solenoid valve for varying the coolant fluid volume.

27. The combination of claim 23 in which said means for controlling comprises by-pass means between the inlet and outlet sides of said first heat transfer means, and by-pass valve means for controlling coolant fluid flow in said by-pass means.

28. The combination of claim 27, in which said by-pass valve means is responsive to sensed temperatures, and said by-pass means is constructed and arranged to simulate the volumetric capacity of the first heat transfer means.

29. In a supermarket refrigeration network comprising:

a first modular refrigeration system unit in close strategic proximity to a first refrigerated product zone, and including a first condensing unit rack comprising first closed circuit refrigeration components including plural multiplexed compressor means, evaporator means and associated high side and low side refrigerant delivery and suction means operatively connected to first evaporator means;

at least one other modular refrigeration system unit in close strategic proximity to an associated second refrigerated product zone, and including a second condensing unit rack comprising second closed circuit refrigeration components including plural multiplexed compressor means, evaporator means and associated high side and low side refrigerant delivery and suction means operatively connected to other evaporator means;

and said first and second refrigeration units also comprising condensing means between said compressor means and evaporator means;

wherein the improvement comprises:

an independent coolant fluid system associated with each of said modular refrigeration system units, each coolant fluid system having first heat transfer means for cooling associated product cooling zones, second heat transfer means comprising a liquid chiller in heat exchange relationship with the evaporator means of the corresponding condensing unit rack for cooling the coolant fluid, pumping means for circulating the coolant fluid in a closed coolant fluid loop through the first and second heat transfer means, the liquid chiller and pumping means of at least one coolant fluid system being disposed on the associated condensing unit rack.

* * * * *